United States Patent [19]

Katsumata et al.

[11] 4,193,385

[45] Mar. 18, 1980

[54] ENGINE STOPPING DEVICE

[75] Inventors: Mitsuo Katsumata; Hiroo Sato, both of Susono; Yoshihiko Ikeda, Shizuoka; Tomikazu Fujita, Katano, all of Japan

[73] Assignee: Kokusan Denki Co., Ltd., Numazu, Japan

[21] Appl. No.: 823,272

[22] Filed: Aug. 10, 1977

[30] Foreign Application Priority Data

| | | | |
|---|---|---|---|
| Aug. 16, 1976 | [JP] | Japan | 51-109473[U] |
| Oct. 5, 1976 | [JP] | Japan | 51-133297[U] |
| Oct. 5, 1976 | [JP] | Japan | 51-133298[U] |
| Oct. 5, 1976 | [JP] | Japan | 51-133299[U] |
| Oct. 5, 1976 | [JP] | Japan | 51-133300[U] |
| Oct. 5, 1976 | [JP] | Japan | 51-133301[U] |
| Oct. 5, 1976 | [JP] | Japan | 51-133302[U] |

[51] Int. Cl.[2] ..... F02B 77/08

[52] U.S. Cl. ..... 123/198 DC; 123/148 S

[58] Field of Search ..... 123/198 DC, 198 D, 148 S, 123/148 CA

[56] References Cited

U.S. PATENT DOCUMENTS

| | | | |
|---|---|---|---|
| 3,703,889 | 11/1972 | Bodig et al. | 123/198 DC |
| 3,863,616 | 2/1975 | Wood | 123/198 DC |
| 3,960,128 | 6/1976 | Anderson | 123/198 DC |
| 3,964,461 | 6/1976 | Wesemeyer et al. | 123/198 DC |
| 4,036,200 | 7/1977 | Kuehn | 123/198 DC |
| 4,073,279 | 2/1978 | Fox | 123/198 DC |

*Primary Examiner*—Ira S. Lazarus

*Attorney, Agent, or Firm*—Pearne, Gordon, Sessions

[57] ABSTRACT

An engine stopping device for stopping an internal combustion engine provided with an ignition system energized by a generator driven by the engine. The stopping device comprises a switch for making ineffective at least one of the elements of the ignition system, an actuator for actuating the switch into the operated state and a retaining device for retaining the switch in the operated state until the engine is brought to a standstill. Although it takes time for the engine to be brought to a standstill, the operator just has to give the actuator one touch operation, such as pressing a button, and may release the actuator before the standstill. Subsequent starting of the engine requires no extra operation.

5 Claims, 21 Drawing Figures

ENGINE STOPPING DEVICE

BACKGROUND OF THE INVENTION

The present invention relates to an engine stopping device for stopping an internal combustion engine provided with an ignition system energized by a generator driven by the engine.

Internal combustion engines for use in a machine such as a small-sized generator or an agricultural machine which is not provided with batteries employ a magneto generator as a power source for the ignition circuit. In these machines, simplicity of construction is indispensable and a key switch, as in a batteries-provided engine, is not employed. The ignition circuit is normally connected with the magneto generator which act as a power source when rotated. The magneto generator, usually mounted on the crank shaft of the engine, is started by means of "rope start" or "kick start".

It is necessary to provide a special means for stopping the engine. Conventionally, a push-button switch is connected across the armature winding of the magneto generator and is pressed, when the engine is to be stopped, to short-circuit the output of the magneto generator. Because of the inertia of the engine and the magneto generator, the engine does not come to a standstill immediately and it takes more than a few seconds. If the push-button switch is released before the engine comes to a stand-still, the engine may be restarted, which may be dangerous. Particularly, where the engine is heated to a high temperature, the engine is easier to re-start even if the push-button is released when the engine is decelerated to a considerably low speed. The above-described arrangement thus requires burdensome operation to keep pressing the push-button for more than about five seconds. Another conventional arrangement employs a snap switch in place of the push-button switch. But with this arrangement, the operator sometimes tries to start the engine while the snap switch is left closed: the result is that the ignition plug is wet with fuel and starting of the engine is made even more difficult.

SUMMARY OF THE INVENTION

An object of the present invention is to provide an engine stopping device for stopping an internal combustion engine provided with an ignition system energized by a generator driven by the engine, the stopping device being capable of reliable stoppage of the engine and causes no inconvenience at the start of the engine.

An engine stopping device according to the invention comprises a stopping switch adapted to make ineffective at least one of the elements forming the ignition system. The element made ineffective may be the ignition power source, such as the exciter coil provided in the magneto generator, or the primary winding of the ignition coil. With an ignition system comprising a breaker for controlling the ignition coil primary current, the breaker may be made ineffective by the switch of the stopping device. With an ignition system comprising a semiconductor switch for controlling the ignition coil primary current, the semiconductor switch or a control signal source controlling the semiconductor switch may be made ineffective. Still alternatively, with an ignition system comprising a capacitor for supplying a discharging current through the ignition coil primary, the capacitor may be made ineffective. To make ineffective the element of the ignition system, the stopping switch of the stopping device is adapted to provide a bypass in shunt with the element to be made ineffective when the engine is to be stopped. Alternatively, the stopping switch of the stopping device is connected in series with the element to be made ineffective, and is opened when the engine is to be stopped.

The engine stopping device may further comprise an actuator for actuating the stopping switching into conductive state when the engine stopping operation is initiated. The engine stopping operation is initiated, for instance, by means of manually operating the actuator to the operated position. The actuator may preferably comprise a self-returning switch, such as a self-returning push-button switch. With the self-returning character of the actuator, there will be no trouble in the starting which may be subsequently conducted. The engine stopping device may further comprise a retaining device for retaining the stopping switch in the operated position until the engine is brought to a standstill, even after the actuator has been released. The retaining device may comprise a capacitor adapted to be charged when the stopping switch is conductive and to provide a signal for holding the stopping switch in conductive state. The capacitor may be further connected to be charged when the actuator is operated, so that initial triggering as well as successive triggering of the stopping switch is achieved by the voltage across the capacitor. In order for the capacitor to be charged when the stopping switch is conductive, the capacitor may be connected across a resistor connected in series with the switch. Where the stopping switch comprises a thyristor, the capacitor may be connected across the gate and cathode of the thyristor so that it is charged by the voltage drop across the gate and cathode of the thyristor. The capacitor may still alternatively be adapted to be charged by a secondary of a transformer whose primary is connected in series with the stopping switch. The power source for charging the capacitor may comprise a voltage across the element to be bypassed, or it may be provided separately.

BRIEF DESCRIPTION OF THE DRAWINGS

Other features and advantages of the present invention will be apparent from the following detailed description of the embodiments taken in conjunction with the accompanying drawings, in which.

DETAILED DESCRIPTION OF THE PREFERRED EMBODIMENTS

Figure 1:
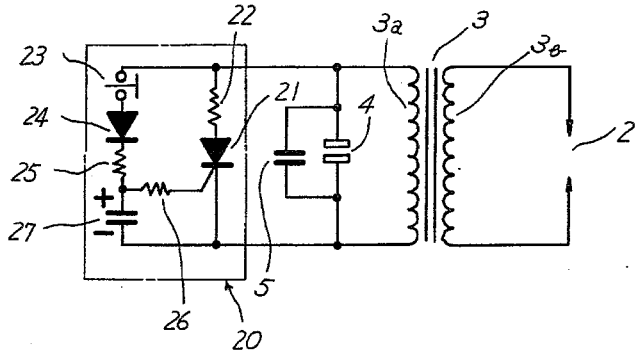
FIGS. 1 through 21 show various embodiments of the engine stopping device according to the present invention.

Referring now more particularly to FIG. 1, there is shown an embodiment of an engine stopping device generally indicated by numeral 20 which is adapted to stop operation of the ignition system and hence the engine, not shown, ignited by an ignition plug 2. The ignition system comprises an ignition coil 3 including a primary winding 3*a* and a secondary winding 3*b* across which the ignition plug 2 is connected. The ignition coil 3 of this embodiment is provided in a magneto generator to act as an ignition power source as well. A breaker 4 is connected across the primary winding 3*a* and is made to close in advance of the ignition timing and to open at the ignition timing, thereby interrupting the primary current which in turn induces a high voltage in the secondary. A capacitor 5 is connected in parallel with the breaker 4 to prevent the spark in the breaker.

The engine stopping device 20 comprises a stopping switch which is shown to be a thyristor 21 having its anode connected through a current limiting resistor 22 to a first end of the primary winding 3a and having its cathode connected directly to the second end of the primary winding 3a. The stopping device 20 further comprises a push-button switch 23 employed as a manually-operated self-returning switch. A diode 24 and resistors 25 and 26 are connected in series with the push-button switch 23, and this series circuit is adapted to couple the first end of the primary winding 3a and the gate of the thyristor 21. A capacitor 27 is provided to serve as means for retaining the conductive state of the thyristor 21 and has one of its terminals connected to the junction between the resistors 25 and 26 and the other terminal connected to the cathode of the thyristor 21.

When stoppage of the engine is desired, the push-button switch is manually closed, the capacitor 27 is charged into a polarity as indicated by "+" and "−" through a path including the push-button switch 23, the diode 24 and the resistor 25 while the output of the power source, namely the primary winding 3a, is, in its positive half cycle, that is positive to the anode of the thyristor 21. As the capacitor 27 is charged the thyristor 21 is triggered and becomes conductive to permit a current to flow therethrough. This will make ineffective the operation of the breaker 4 since the variation of the primary current is reduced and the secondary voltage becomes insufficient.

As long as a current is flowing through the thyristor 21, a voltage drop of about 0.6–1.0 V appears across the gate and the cathode. This voltage drop is applied across the capacitor 27 through the resistor 26 and the capacitor 27 is thereby charged to a voltage of about 0.6–1.0 V.

As the output voltage of the primary winding 3a goes negative the thyristor 21 is turned off. Gradual discharge of the capacitor 27 takes place, but the voltage across the capacitor 27 remains sufficient until the subsequent positive half cycle.

As the subsequent positive half cycle begins, with the voltage across the capacitor 27 being kept applied across the gate and cathode of the thyristor 21, the thyristor is turned on again. And the ignition operation of the ignition system is prevented.

Ignition-preventing operation of the engine stopping device is repeated until the engine is brought to a standstill and the primary winding 3a no longer generates an output voltage.

After the engine has come to a standstill the capacitor 27 is gradually discharged through the resistor 26 and the gate and cathode of the thyristor 21. With the capacitor 27 discharged, the next starting of the engine will be accomplished without trouble.

In the aforesaid construction, the voltage across the capacitor 27 charged by the voltage drop across the gate and cathode of the thyristor 21 is as low as 0.6–1.0 V. But, where a thyristor having a high gate sensitivity is adopted, the thyristor can be turned by a gate-cathode voltage of about 0.2–0.4 V, so that there will be no failure of turn-on.

Figure 2:
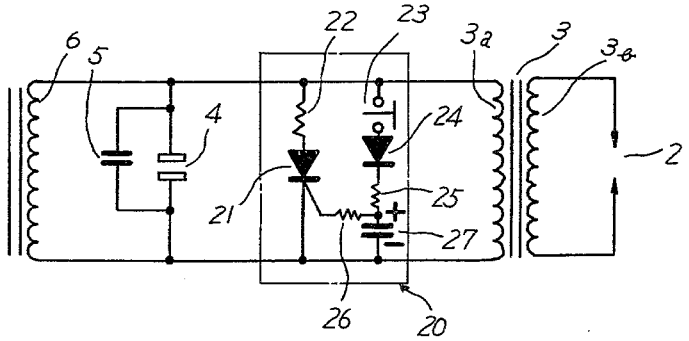

FIG. 2 shows the engine stopping device similar to that of FIG. 1 and adapted to an ignition system incorporating a separate power source 6, shown to be an exciter coil provided in a magneto generator and connected across the primary winding 3a. The rest of the construction is similar to that of FIG. 1. While the exciter coil produces a positive output, the breaker 4 is closed in advance of the ignition timing, and is opened at the ignition timing to interrupt the short-circuit current having been flowing therethrough. This in turns causes a large current to flow through the primary winding 3a. The engine stopping device 20 operates in a manner substantially similar to that explained with reference to FIG. 1.

Figure 3:
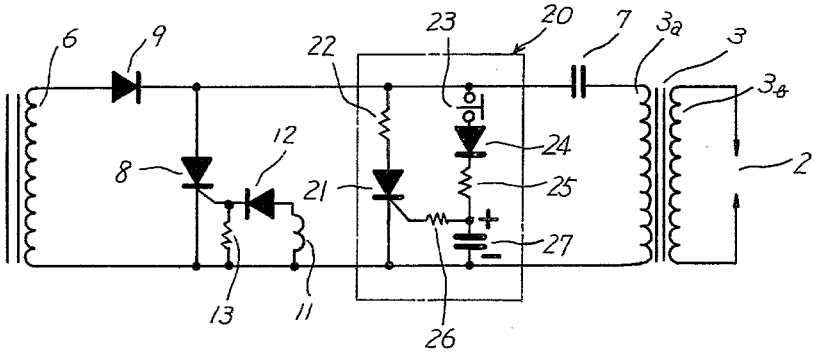

FIG. 3 shows an engine stopping device similar to that of FIG. 1 or FIG. 2 adapted to a capacitor discharge ignition system wherein a capacitor 7 is connected to be charged by an exciter coil 6 through a diode 9 and to be discharged through the primary winding 3a and a thyristor 8 when the thyristor is turned on at the ignition timing by a pulse generator 11 supplying a trigger pulse at the ignition timing through a diode 12 to the thyristor's gate coupled by a resistor 13 to the cathode of the thyristor. The thyristor 21 of the engine stopping device 20 is connected through the resistor 22 across the ignition power source which consists of the exciter coil 6 and the diode 9. The resistor 26 and the capacitor 27 are connected in series connection, and the series circuit is connected across the gate and the cathode of the thyristor 21. The push-button switch 23 is adapted to couple the gate of the thyristor 21 and the ignition power source so that a trigger signal is supplied to the thyristor when the push-button switch 23 is closed. In this embodiment, the push-button switch 23 is connected in series with the diode 24 and resistors 25 and 26, and this series circuit couples the cathode of the diode 9 and the gate of the thyristor 21.

Figure 4:
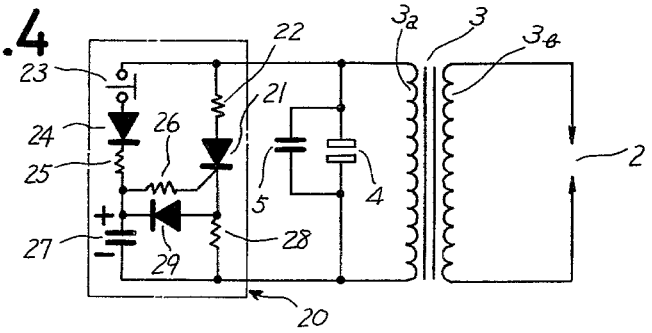

FIG. 4 shows another embodiment of the engine stopping device adapted to an ignition system similar to that of FIG. 1. The engine stopping device 20 of this embodiment is similar to that of FIG. 1, 2 or 3, except that a diode 29 is provided to have its anode connected to the cathode of the thyristor 21 and to have its cathode connected to the junction between the resistor 25 and one terminal of the capacitor 27, and that a resistor 28 is also provided to have one end connected to the cathode of the thyristor 21 and to have the other end connected to the other terminal of the capacitor. 27. When the thyristor 21 is conductive the capacitor 27 is charged by the voltage across the resistor 28 through the diode 29 to a voltage dependent on the resistance of the resistor 28. With a sufficient charging voltage, turn-on of the thyristor 21 is ensured. The engine stopping device shown in FIG. 4 may be incorporated in any of the ignition systems shown in FIGS. 1–3.

In the various embodiments described above, the diode 24 may be omitted. It is also noted that the current limiting resistor 22 may be omitted if the thyristor 21 has a sufficient current capacity or the ignition power source, the primary winding 3a or the exciter coil 6 has a sufficient current limiting impedance.

Figure 5:
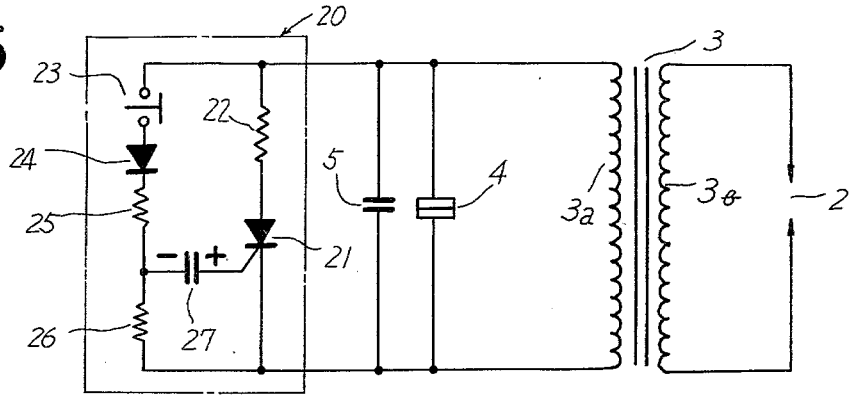

FIG. 5 shows still another embodiment of the engine stopping device adapted to an ignition system similar to that of FIG. 1. The engine stopping device of this embodiment is similar to that of FIG. 1 except that the positioning of the resistor 26 and the capacitor 27 is reversed. When the push-button switch 23 is closed a charging current flows through the capacitor 27 and the gate and cathode of the thyristor 21 during the first positive half cycle, so that the thyristor 21 is turned on. When the thyristor is conducting the capacitor 27 is charged by the voltage drop across the gate and cathode of the thyristor 21 and supplies trigger signal during successive positive half cycles.

Figure 6:
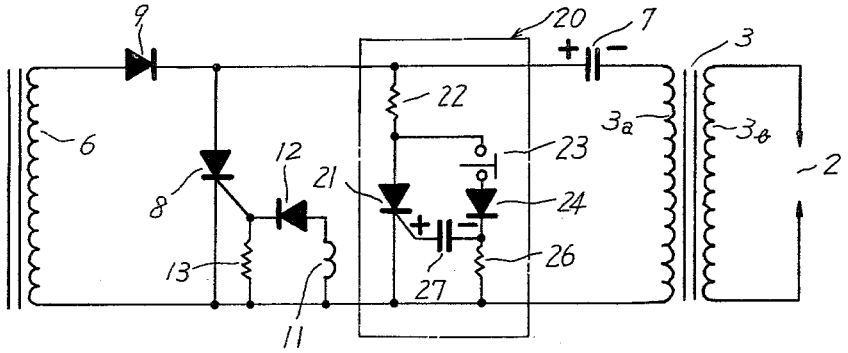

FIG. 6 shows still another embodiment of the engine stopping device adapted to an ignition system similar to that of FIG. 3. The engine stopping device of this embodiment comprises a series circuit of a thyristor 21 and a thyristor 22. A capacitor 27 is provided to have one of its terminals connected to the gate of the thyristor 21 and to have the other terminal connected to the cathode of the thyristor 21 through a resistor 26 and also connected to the cathode of a diode 24, whose anode is coupled to the anode of the thyristor 21 by a push-button switch 23. As the push-button switch 23 is closed, a charging current flows through the capacitor 27 and the gate and cathode of the thyristor 21 during positive half cycle. When the push-button switch 23 is opened, the conducting thyristor 21 charges the capacitor 27 for the subsequent triggering.

Figure 7:
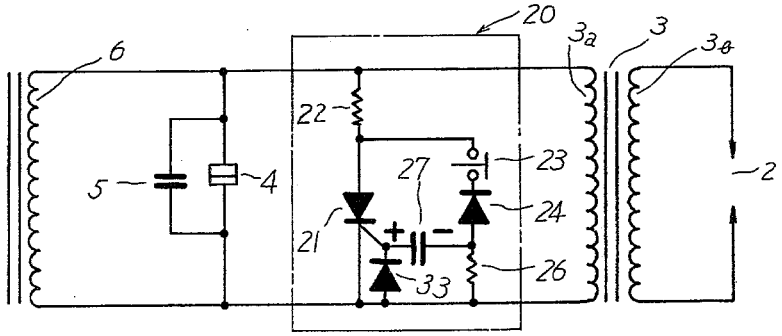

FIG. 7 shows still another embodiment of the engine stopping device adapted to an ignition system similar to that of FIG. 2. The engine stopping device of this embodiment is similar to that of FIG. 6 except that the diode 24 is connected in the reverse direction and a further diode 33 is provided to have its anode connected to the cathode of the thyristor 21 and to have its cathode connected to the gate of the thyristor 21. As the push-button switch 23 is closed, the exciter coil 6 provides, in its negative half cycle, a charging current through the diode 33, the capacitor 27, the diode 24, the switch 23 and the resistor 22, so that the capacitor 27 is charged into a polarity indicated by "+" and "−". With sufficient charge on the capacitor, the thyristor 21 is triggered during the subsequent positive half cycle. After the switch 23 is opened, the conducting thyristor 21 charges the capacitor.

Figure 8:
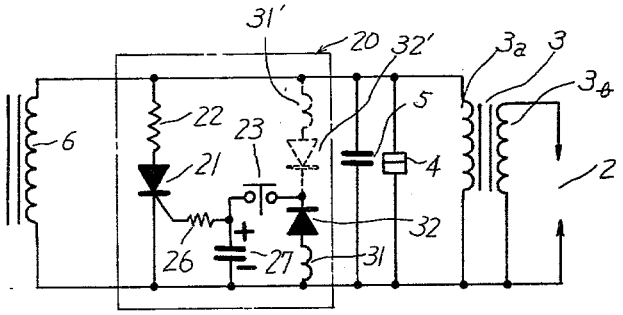

FIG. 8 shows still another embodiment of the engine stopping device adapted to an ignition system similar to that of FIG. 2. The thyristor 21 is connected across the power source 6 through a resistor 22 having one end connected to the anode of the thyristor 21. The thyristor 21 is also provided with a resistor 26 having one end connected to the gate of the thyristor and having the other end connected to one terminal of a capacitor 27, the other terminal of which is connected to the cathode of the thyristor 21 in the same way as in FIGS. 1–3. A separate generating coil 31, which may be provided in the same magneto generator as the exciter coil 6, is adapted to give initial charge to the capacitor 27 and is connected through a diode 32 and a push-button switch 23 across the capacitor 27.

When engine stopping operation is initiated by closing the switch 23 the capacitor 27 is charged by the generating coil 31, and when it is sufficiently charged it supplies a trigger signal to the thyristor 21. With the thyristor 21 being turned on, the engine stopping device 20 operates to prevent igniting operation of the ignition system.

It is noted that the generating coil 31 may alternatively be connected as to supply a charging current to the capacitor through the primary winding **3*a* and/or the exciter coil 6, as shown by dotted lines and numerals 31' and 32'**.

Figure 9:
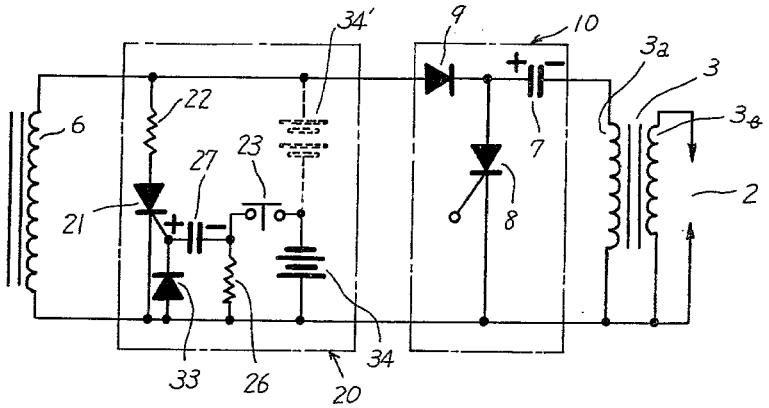

FIG. 9 shows another embodiment of the engine stopping device adapted to control a capacitor discharge ignition system including a capacitor 7 charged by the exciter coil 6 through a diode 9 and discharged through the primary winding **3*a* and a thyristor 8 adapted to be triggered by a trigger circuit not shown. The capacitor 7, the diode 9 and the thyristor 8 with the trigger circuit from a primary current control circuit 10**.

In the engine stopping device of this embodiment, a capacitor 27 for retaining the thyristor 21 in conductive state has one terminal connected to the gate of the thyristor 21 and has the other terminal connected through a resistor 26 to the cathode of a thyristor 21. A diode 33 is provided to have its anode connected to the cathode of the thyristor 21 and to have its cathode connected to the gate of the thyristor 21, thereby forming a path for a charging current together with a push-button switch 23 coupling the junction between the capacitor 27 and the resistor 26 and a negative output terminal of a battery 34 which is employed as a charging power source.

When the push-button switch 23 is closed, the capacitor 27 is charged by the battery through the diode 33 into the polarity indicated by "+" and "−". With sufficient charge on the capacitor, a discharging current tends to flow through the gate and cathode of the thyristor 21 and the resistor 26. Thus, the thyristor 21 is turned on every time the exciter coil 6 produces a positive output. the voltage drop across the gate and cathode of the thyristor 21 is applied across the series circuit of the capacitor 27 and the resistor 26. Thus the capacitor 27 is charged to a necessary voltage even after the push-button switch 23 is opened.

The battery may alternatively be so adapted, as shown by dotted lines and the primed numerals, as to charge the capacitor 27 through the primary winding **3*a* and/or the exciter coil 6**.

Figure 10:
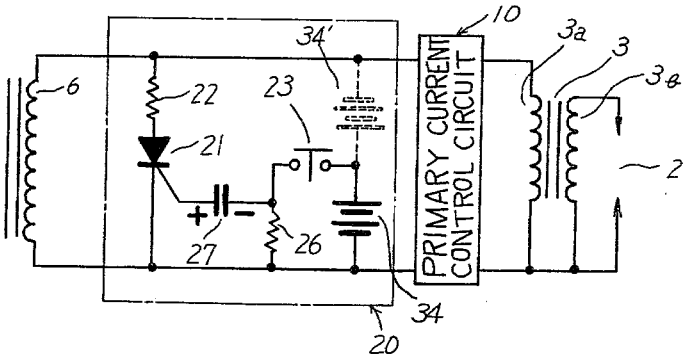

FIG. 10 shows another embodiment of the engine stopping device similar to that of FIG. 9 except that the diode 33 of FIG. 9 is omitted and the battery 34 is connected in reverse polarity. Initial triggering of the thyristor 21 is achieved when the switch 23 is closed to permit a charging current to charge the capacitor into a polarity opposite to that indicated. After the thyristor 21 is turned on, the capacitor 27 is charged into the polarity indicated by the voltage drop across the gate and cathode of the thyristor 21. The subsequent triggering of the thyristor 21 is achieved by the discharging current from the capacitor 27.

Dotted lines and the numeral 34' indicate an alternative connection of the battery.

It would be apparent to those skilled in the art that the batteries of FIGS. 9 and 10 may be replaced by a series circuit of a generating winding together with a rectifier.

Figure 11:
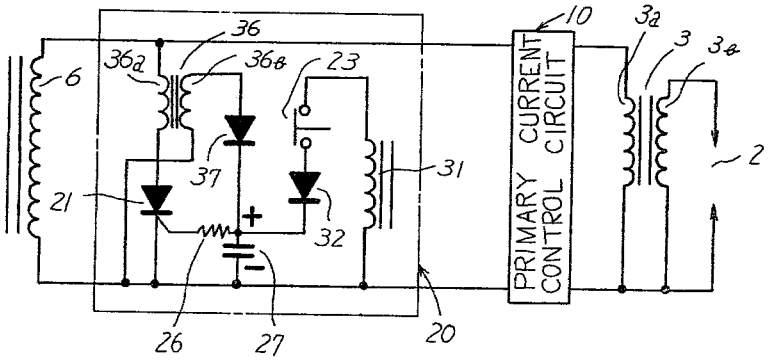

FIG. 11 shows another embodiment of the engine stopping device in which the capacitor 27 for retaining the thyristor in conductive state is adapted to be charged by a secondary **36*b* of a transformer 36 whose primary 36*a* is in series with the thyristor 21. Initial charging of the capacitor 27 is achieved by a generating coil 31 through the diode 32 and a push-button switch 23. A resistor 26 is provided to enable application of the voltage on the capacitor 27 to the gate of the thyristor 27. When the thyristor 21 is turned on, the secondary 36*b* supplies a charging power to charge the capacitor 27 so that the capacitor 27 is ready for the subsequent triggering. The capacitor 27** can be charged to a higher voltage, so that possibility of failure to turn on the thyristor is further reduced.

Figure 12:
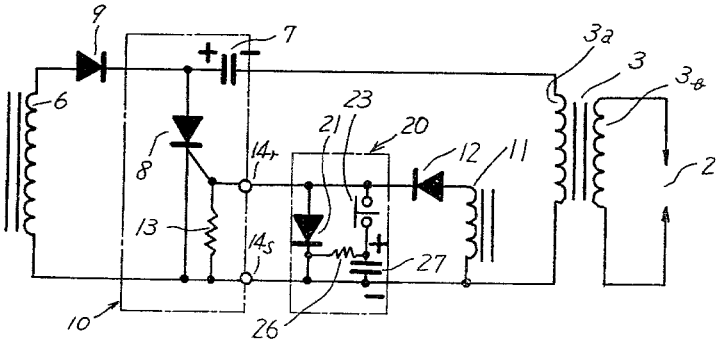

FIG. 12 shows still another embodiment of the engine stopping device adapted to a capacitor discharge ignition system similar to that of FIG. 3. The engine stopping device of this embodiment is provided to bypass the trigger signal supplied by the pulse generator 11 to the gate of the thyristor 8 for discharging the capacitor. To achieve such function, a thyristor 21 is provided to have its anode and cathode connected respectively to the gate and cathode of the thyristor 8. A capacitor 27 for retaining the thyristor 21 in the conductive state has one of its terminals connected to the cathode of the thyristor 21 and has the other terminal connected through a resistor 26 to the gate of the thyristor 21. A push-button switch 23 is provided to couple the anode of the thyristor 21 and the junction between the resistor 26 and the capacitor 27. As the push-button switch 23 is closed, the pulse generator 11 charges the capacitor 27 into the polarity shown, so that the thyristor 21 becomes conductive, and trigger signal to the thyristor 8 is bypassed. Without conduction of the thyristor 8, the primary current control circuit generally indicated at 10 does not operate and hence ignition does not take place. The conducting thyristor 21 charges the capacitor 27, so that the thyristor 21 is triggered in the subsequent positive half cycle. This will be repeated as long as the pulse generator 11 produces an output, that is, as long as the engine rotates.

Figure 13:
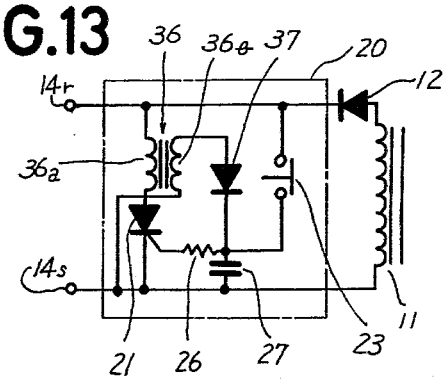

FIG. 13 shows another embodiment of the engine stopping device adaptable to an ignition system of FIG. 12. The engine stopping device of this embodiment is similar to that of FIG. 11. The terminals 14*r* and 14*s* may be connected to the gate and cathode of a thyristor of a primary current control circuit 10 such as shown in FIG. 12. The primary winding 36*a* of a transformer 36 has one end connected to the terminal 14*r* and has the other end connected to the anode of a thyristor 21, whose cathode is connected to the terminal 14*s*. The secondary winding 36*b* of the transformer 36 has one of its ends connected to the terminal 14*s* and has the other end connected to the anode of a diode 37, whose cathode is connected through a resistor 26 to the gate of the thyristor 21 and through a capacitor 27 to the cathode of the thyristor 21. A push-button switch 23 couples the cathode of the diode 37 and the terminal 14*r*. Initial charging of the capacitor 27 necessary to begin conduction of the thyristor 21 is achieved by the pulse generator 11 when the push-button switch 23 is closed. The subsequent charging of the capacitor 27 is achieved by the secondary winding 36*b* which induces a voltage every time the thyristor 21 is turned on.

In the embodiments of FIGS. 12 and 13, the generating coil 11 for supplying a trigger signal to the thyristor 8 is also used to supply a charging current to the capacitor 27. But there may be provided a separate generating winding for charging the capacitor 27, as in FIGS. 8 and 11.

Figure 14:
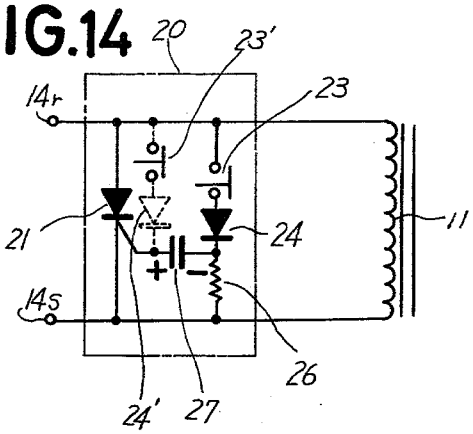

FIG. 14 shows another embodiment of the engine stopping device similar to that of FIG. 12 except that the positioning of the capacitor 27 and the resistor 26 is reversed and a diode 24 is connected in series with the push-button switch. As the push-button switch 23 is closed a charging current flows through the capacitor 27 and the gate and cathode of the thyristor 21, so that the thyristor 21 is turned on. Subsequent triggering of the thyristor 21 is effected by the charge on the capacitor 27 which is supplied by the voltage drop across the gate and cathode of the conducting thyristor 21, in a similar manner as the embodiment of FIG. 10.

The series circuit of the push-button switch 23 and the diode 24 may be connected as shown by dotted lines and the numerals 23' and 24'. With this construction, the initial triggering of the thyristor 21 is achieved when the capacitor 27 is charged to a sufficient voltage.

The embodiment of FIG. 14 (with the solid line) may be so modified that, as in FIG. 9, a diode (33) is provided across the gate and cathode of the thyristor 21 and the direction of the diode 24 is reversed, so that the initial charging current flows through the diode (33) so inserted, the reversed diode (24), the push-button switch 23 being closed and the coil 11 producing a negative output.

Figure 15:
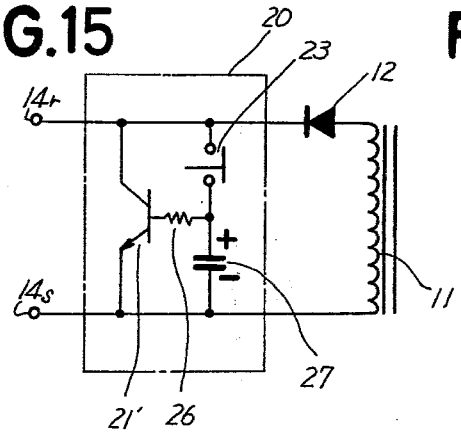

FIG. 15 shows another embodiment of the engine stopping device similar to that of FIG. 12 except that the thyristor 21 is replaced by a transistor 21' to exemplify that in all of the embodiments described herein any type of switching means may be employed to substitute for the thyristor. The time interval in which the transistor 21' is kept conductive after release of the push-button switch is determined by the time necessary for discharge of the capacitor 27.

Figure 16:
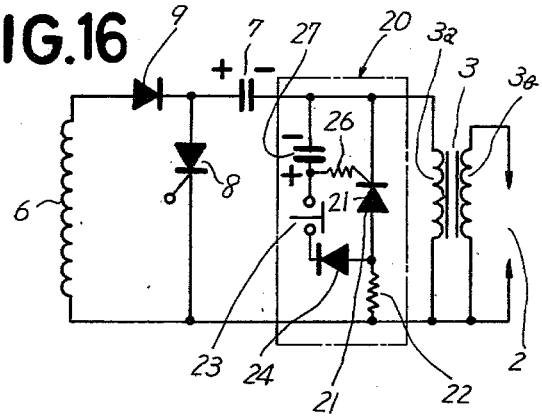

FIG. 16 shows another embodiment of the engine stopping device adapted to a capacitor discharge ignition system. The engine stopping device of this embodiment comprises a thyristor 21 connected to provide a bypass in shunt with the primary winding 3*a* for the discharging current from the capacitor 7. More particularly a series circuit of a thyristor 21 and a resistor 22 is connected in parallel with the primary winding 3*a* to form a closed loop with the capacitor 7 and a thyristor 8 for discharging the capacitor 7 at the ignition timing. A push-button switch 23 for initiating the engine stopping operation is connected to couple the cathode of a diode 24 whose anode is connected to the anode of the thyristor 21 and a first end of a resistor 26 the second end of which is connected to the gate of the thyristor 21. A capacitor 27 for retaining the thyristor 21 in conductive state is connected across the first end of the resistor 26 and the cathode of the thyristor 21.

When the push-button switch 23 is closed, the capacitor 27 is charged by the discharging current from the capacitor 7 and, when charged to a sufficient level, triggers the thyristor 21. As the thyristor 21 is conductive, a substantial part of the discharging current from the capacitor 7 flows through the thyristor 21. After the push-button switch is opened the charging of the capacitor 27 is effected by the voltage drop across the gate and cathode of the conducting thyristor 21 so that the subsequent turn-on of the thyristor 21 is ensured. Thus the ignition of the engine is prevented although the charging and discharging of the capacitor 7 is repeated until the engine is brought to a standstill.

It is noted that the engine stopping device shown in FIG. 6, 7, 8 or 11, or the like may also be used to bypass the discharging current to reduce the primary variation. Furthermore, these engine stopping devices may also be incorporated in other types of ignition systems.

Figure 17:
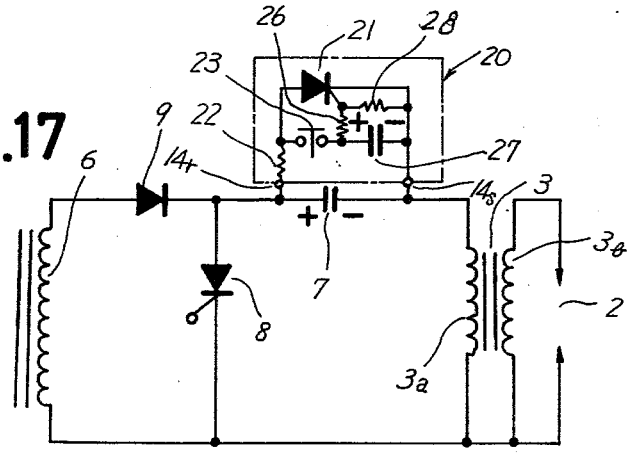

FIG. 17 shows another embodiment of the engine stopping device 20 adapted to a capacitor discharge ignition system. The engine stopping device of this embodiment has a construction similar to that of FIG. 6 except that the diode 24 of FIG. 6 is omitted and that an additional resistor 28 is connected across the gate and cathode of the thyristor 21. The engine stopping device of the embodiment is adapted to prevent charging of a capacitor 7 when engine is to be stopped.

It is also noted other types of engine stopping devices hereinbefore described may also be utilized to prevent charging of the capacitor 7.

It is noted that in the various embodiments hereinabove described, various modifications may be made. For instance, the current limiting resistor 22 connecting in series with the stopping switch such as the thyristor 21 may be replaced by a diode or a plurality of diodes connected in series with each other. The current limiting resistor 22 may be omitted if the stopping switch has a sufficient current capacity or the ignition power source, such as the exciter coil 6 or the ignition coil primary 3*a* has a sufficient internal impedance. Also, the diode 24 connected in series with the push-button switch 23 may be omitted. Moreover the resistor 28, in FIG. 17, connected directly across the gate and cathode of the thyristor 21 may be omitted, or in other embodiments, a similar resistor may be provided to protect the thyristor.

Figure 18:
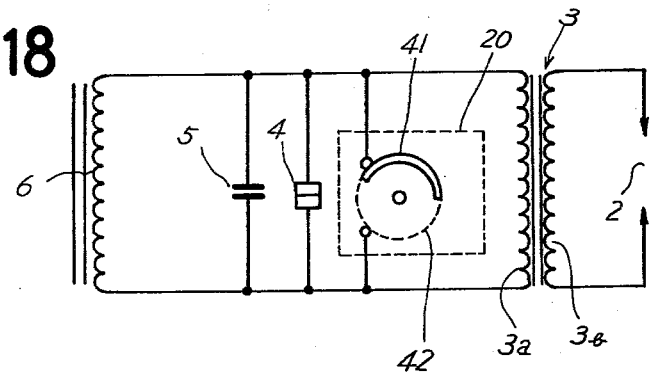

FIG. 18 shows another embodiment of the engine stopping device adapted to an ignition system similar to that of FIG. 2. The engine stopping device of this embodiment comprises a mechanically driven contact 41 driven by a contact drive 42 which drives the contact in closing position when a push-button or a lever, not shown, is manually operated, and retains the contact in the closing position for a predetermined time after the push-button or the lever is released. Such function is accomplished by a mechanism wherein an arcuate contact is rotated along an arcuate path to be brought to the closing position and a spring is tensioned when a push-button or the like is manually operated, and when the push-button is released the spring slowly rotates the contact in the opposite direction so that a sufficient time elapses before the contact is returned to the opening position.

The closure of the mechanically operated contact 41 yields the same effect as the conduction of the thyristor 21 of FIG. 2.

The engine stopping device of FIG. 18 may be incorporated in the various ignition systems to bypass various portions of the ignition systems, such as the primary winding, or the capacitor of a capacitor discharge ignition system.

Figure 19:
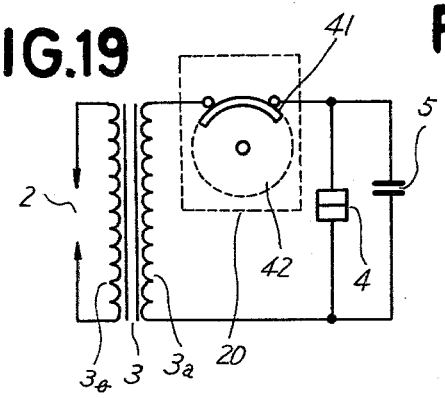

FIG. 19 shows another embodiment of the engine stopping device adapted to an ignition system similar to that of FIG. 1. The engine stopping device 20 of this embodiment comprises a mechanically-operated rotatable arcuate contact similar to that of FIG. 18 except that the contact is of a normally-closed type. When the engine is to be stopped the contact 41 is opened, so that the opening-and-closing operation of the breaker 4 becomes ineffective on the ignition coil 3. This type of normally-closed contact may be used in series with various elements of ignition systems, such as for instance the ignition power source, the primary winding, or the capacitor of a capacitor discharge ignition circuit.

Figure 20:
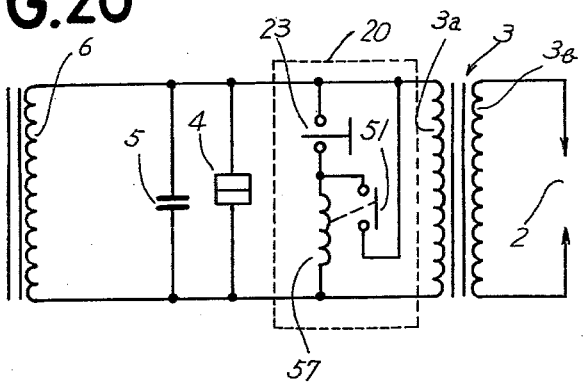

FIG. 20 shows another embodiment of the engine stopping device adapted to an ignition system similar to that of FIG. 2. The engine stopping device of this embodiment comprises a normally-open contact 51 of an electromagnetic relay and a magnet coil 57 of the electromagnetic relay for driving the contact into closed position and retaining the contact in the closed position as long as it is energized. The contact 51 is connected in series with the magnet coil 57 so that they form a self-retentive circuit. The initial energization of the magnet coil 57 is achieved by a push-button switch 23 which is connected in parallel with the contact 51. Closure of the push-button switch 23 and/or the contact 51 provides a low impedance bypass in shunt with the breaker 4, so that make-and-break operation of the breaker 4 does not cause sufficient variation of the primary current of the ignition coil 3.

The engine stopping device of FIG. 20 may alternatively be adapted to provide a bypass in shunt with various elements of the ignition system, such as the ignition power source, the primary winding 3*a*, or the capacitor of a capacitor discharge ignition system.

It will also be understood that a normally-closed contact of an electromagnetic relay may be utilized to break a circuit when the engine is to be stopped while a magnet coil with a self-retentive contact is connected to be energized by the ignition power source even after the normally-closed contact is opened. The normally-closed contact may for instance be connected in series with the ignition power source, the primary winding, a capacitor of a capacitor discharge ignition system, or the like.

Figure 21:
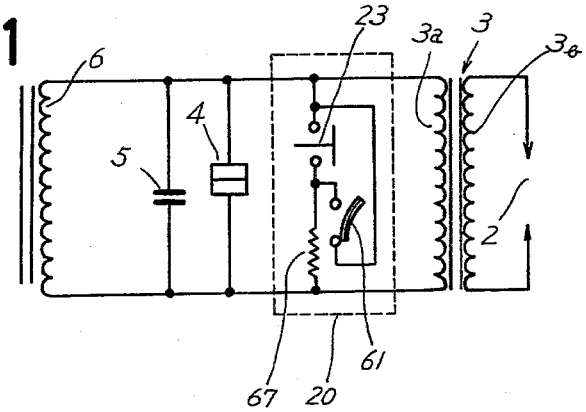

FIG. 21 shows another embodiment of the engine stopping device adapted to an ignition system similar to that of FIG. 2. The engine stopping device of this embodiment comprises a normally-open bimetal switch 61 positioned to be heated by a resistor 67 connected in series with the bimetal switch 61. The initial energization of the resistor 67 is achieved by closing a push-button switch 23 connected in parallel with the bimetal switch 61. When operated, the engine stopping device of this embodiment provides a low impedance bypass in shunt with the breaker 4, making ineffective the operation of the breaker.

It will be noted that the engine stopping device similar to that of FIG. 21 may be adapted to provide a bypass in shunt with other circuit elements of an ignition system. Although the bimetal switch itself is shown to constitute a switch to make ineffective the element, a contact driven by a bimetal may be utilized for that purpose. Such a contact may be of a normally-open type where the circuit element is to be bypassed, or of a normally-closed type where the circuit is to be broken. The power source of the heater may be separately provided.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

For instance, in the various embodiment described above, the diode 24 in series with the push-button switch may be omitted. Also, the current limiting resistor 22 may be omitted if the thyristor 21 has a sufficient current capacity or if the ignition power source, the exciter coil 6 or the primary winding 3*a*, has a sufficient internal impedance.

It is also noted that the various engine stopping devices according to the present invention can be adapted to any of the ignition systems illustrated as well as others which are known. For instance the engine stopping device may be adapted to provide a bypass in shunt with a breaker or a semiconductor switch connected in series with a primary winding of an ignition coil to control the primary current.

What is claimed is:

1. An engine stopping device for stopping an internal combustion engine provided with an ignition system energized by a generator driven by the engine, said stopping device comprising a first thyristor for providing a bypass in shunt with a power source of the ignition system, said thyristor being connected across the ignition power source, a series circuit of a resistor and a capacitor, said series circuit being connected across a gate and cathode of said thyristor so that said capacitor is charged by the voltage drop across the gate and cathode of said thyristor, and a manually-operated self-returning switch which is adapted to couple said ignition power source and the gate of said thyristor so that a trigger signal is supplied to said thyristor when the self-returning switch is operated to stop the engine.

2. An engine stopping device as set forth in claim 1, wherein the ignition system comprises a semiconductor switch for controlling the primary current of the ignition coil and said thyristor is adapted to provide a bypass in shunt with the semiconductor switch.

3. An engine stopping device as set forth in claim 1, wherein the ignition system comprises a second thyristor for controlling the primary current of the ignition coil and said is adapted to provide a bypass across the anode and cathode of the said second thyristor.

4. An engine stopping device as set forth in claim 1, wherein said capacitor is connected through said self-returning switch across said ignition power source.

5. An engine stopping device as set forth in claim 4, further comprising a diode and said capacitor is connected through said diode across said ignition power source.

* * * * *